United States Patent [19]

Glomski et al.

[11] Patent Number: 4,665,885

[45] Date of Patent: May 19, 1987

[54] MISSILE-THROWING WEAPON

[76] Inventors: Stanislas Glomski, Chemin de la Rivière, St-Fèlix de Kingsey, Canada, J0B 2T0; Patrick Roseberry, 3675 St-Pierre Street, Drummondville, Canada, J2B 6V2

[21] Appl. No.: 817,595

[22] Filed: Jan. 10, 1986

[51] Int. Cl.[4] ..... F41B 15/00

[52] U.S. Cl. ..... 124/27; 124/37

[58] Field of Search ..... 124/27, 31, 26, 25, 124/37

[56] References Cited

U.S. PATENT DOCUMENTS 1,097,244 5/1914 Lefever ..... 124/27

FOREIGN PATENT DOCUMENTS 5013 7/1975 Canada .

*Primary Examiner*—Richard C. Pinkham

*Assistant Examiner*—Gary Jackson

[57] ABSTRACT

A weapon for propelling missiles, such as arrows, quarrels and the like, which looks like a sub-machine gun and is characterized by a compact missile-propelling assembly which is co-planar with the stock, contrary to the long bow which extends transversely of the stock of a conventional cross-bow. The missile-propelling assembly includes a modified toggle lever system which is spring actuated and is arranged to constantly accelerate the missile during the propelling stroke. The lever system is braked by the spring at the end of the propelling stroke, thereby avoiding any noise.

13 Claims, 10 Drawing Figures

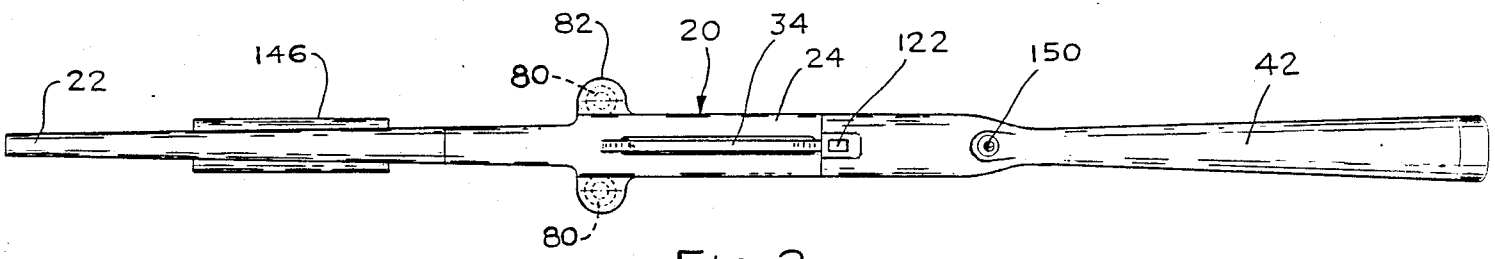
FIG. 2
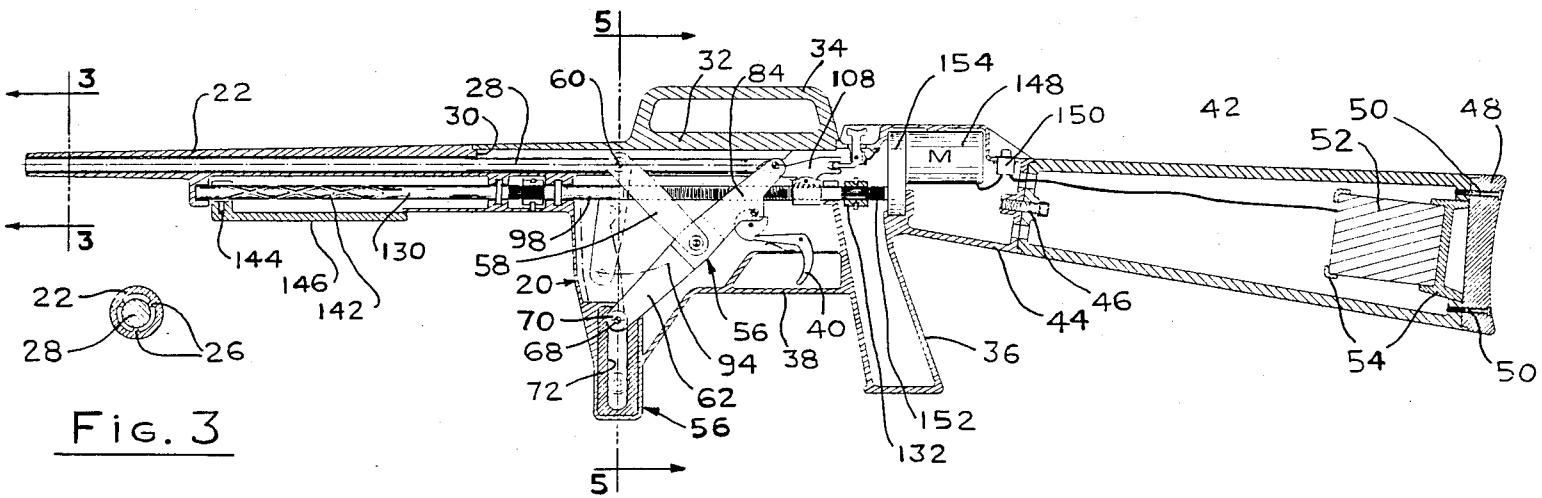
FIG. 1
FIG. 3

MISSILE-THROWING WEAPON

FIELD OF THE INVENTION

The present invention relates to the field of archery, and especially to a weapon which is an improvement of the conventional cross-bow.

BACKGROUND OF THE INVENTION

Despite considerable use of firearms nowadays, archery still remains a sport that is practised by quite a few enthusiasts. For these sportsmen, bow and arrows are the most exhilirating way to make a kill on a game animal. It requires strength in the bending of the bow, skill in the aiming at the animal; one needs to come sufficiently close to the animal before the speed of the arrow can be high enough to kill, whereas the game animal has its chance of seeing the hunter and escaping same; and because the effectiveness of the bow is limited to a short range, there is a certain level of dangerousness for the hunter in the event, which do enhance the sporting dimension thereof. Also, since the effective range of the arrow is limited to 100 meters or so, the possibility to injure a non-targeted animal or human being is almost eliminated.

The conventional cross-bow includes a bow mounted transversely on a stock and provided with a cocking mechanism which enables the use of a bow of greater strength than a simple bow. Therefore, the cross-bow has a range of about twice that of a simple bow. A major disadvantage of the cross-bow is that the transversely-mounted bow is highly cumbersome, especially when the hunter walks or crawls in wooden areas, and this reduces his chances of approaching the game animal unnoticed.

OBJECTS OF THE INVENTION

Therefore, the general object of the present invention is to develop a weapon capable of propelling elongated missiles, such as arrows, quarrels and the like, at as great speed as that of a conventional cross-bow, but with the cumbersome bow thereof replaced by a compact propelling mechanism arranged in the plane of the stock of the weapon.

Another object of the invention is to provide a weapon of the character described, in which the propelling mechanism, which includes a linear acting spring, is arranged to propel the missiles in a constantly accelerating movement, despite constant movement of a slide block acted upon by the spring.

Another object of the present invention resides in the provision of a propelling mechanism of the character described, in which the spring itself acts as a shock-absorber at the end of the propelling stroke.

Another object of the present invention is to provide a weapon of the character described, in which the propelling mechanism can be easily cranked to its cocking position.

Another object of the present invention is to provide a weapon of the character described, having the general external appearance of a sub-machine gun.

SUMMARY OF THE INVENTION

There is disclosed a weapon for propelling elongated missiles which comprises a rigid elongated body forming a back stock and a front elongated straight missile-guiding member having a first longitudinal axis, a missile-propelling mechanism carried by the body and including a missle-engaging member movable along said first axis between a rearward cocked position and a forward limit position, a first lever pivoted to the body at one end about a second axis transverse to and intersecting said first axis and forwardly spaced from the cocked position of said missile-engaging member, a second lever centrally pivoted to the free end of said first lever about a third axis parallel to said second axis, a straight slide fixed to the body and normal to said first axis, a slide block guided by said slide for reciprocating movement, one end of the second lever pivoted to the slide about a fourth axis parallel to said second and third axes, the other end of said second lever carrying said missile-engaging member, the distance between said second and third axes being equal to the distance between said third and fourth axes and to the distance between said first axis and said missile-engaging member, biasing means carried by said body and biasing said slide block away from said first axis, catch means carried by said stock for retaining said missile-engaging member in cocked position against the bias of said biasing means, and trigger means carried by said stock for releasing said catch means and allow missile-propelling movement of said mechanism under the action of said biasing means, constant speed movement of said slide block away from said first axis causing forward linear accelerating movement of said missile-engaging member along said first axis, said first lever forwardly pivoting during this movement from a rearwardly-extending position taken when said missile-engaging member is in its cocked position. During the propelling movement of the lever mechanism, the slide block attains a limit position in which the second, third and fourth axes are in alignment, this limit position corresponding to a maximum elongated position of the biasing means. Preferably, the lever mechanism is allowed to move beyond this limit position during the propelling stroke, whereby the lever mechanism is gradually brought to a stop under the action of the biasing means which are thereby compressed.

BRIEF DESCRIPTION OF THE DRAWINGS

FIG. 1 is a longitudinal section of the weapon;

FIG. 2 is a top plan view of the same;

FIG. 3 is a cross-section of the barrel taken along line 3—3 of FIG. 1;

In the drawings, like reference characters indicate like elements throughout.

DETAILED DESCRIPTION OF THE PREFERRED EMBODIMENTS OF THE INVENTION

Figure 4:
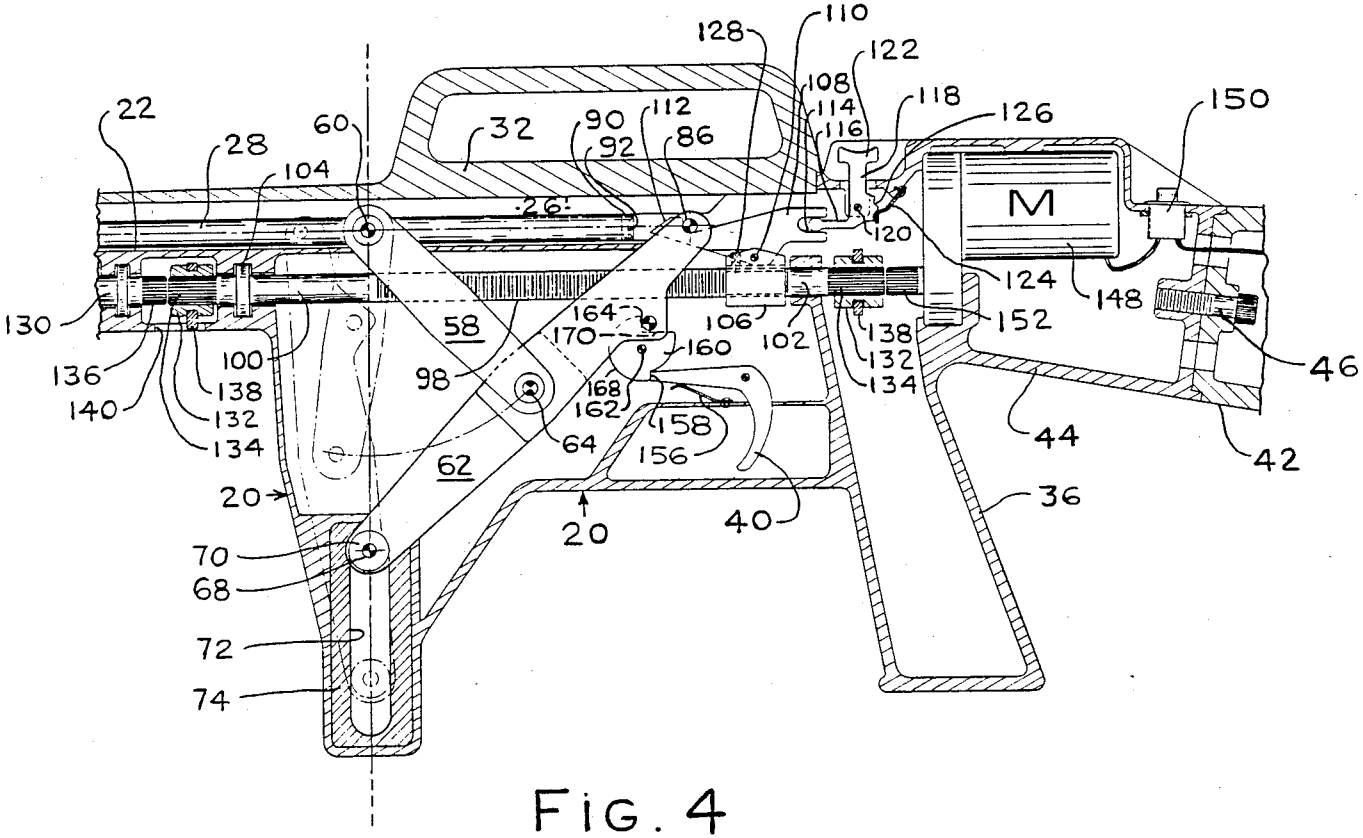
FIG. 4 is a longitudinal section, on an enlarged scale, of a portion of the weapon.
Figure 5:
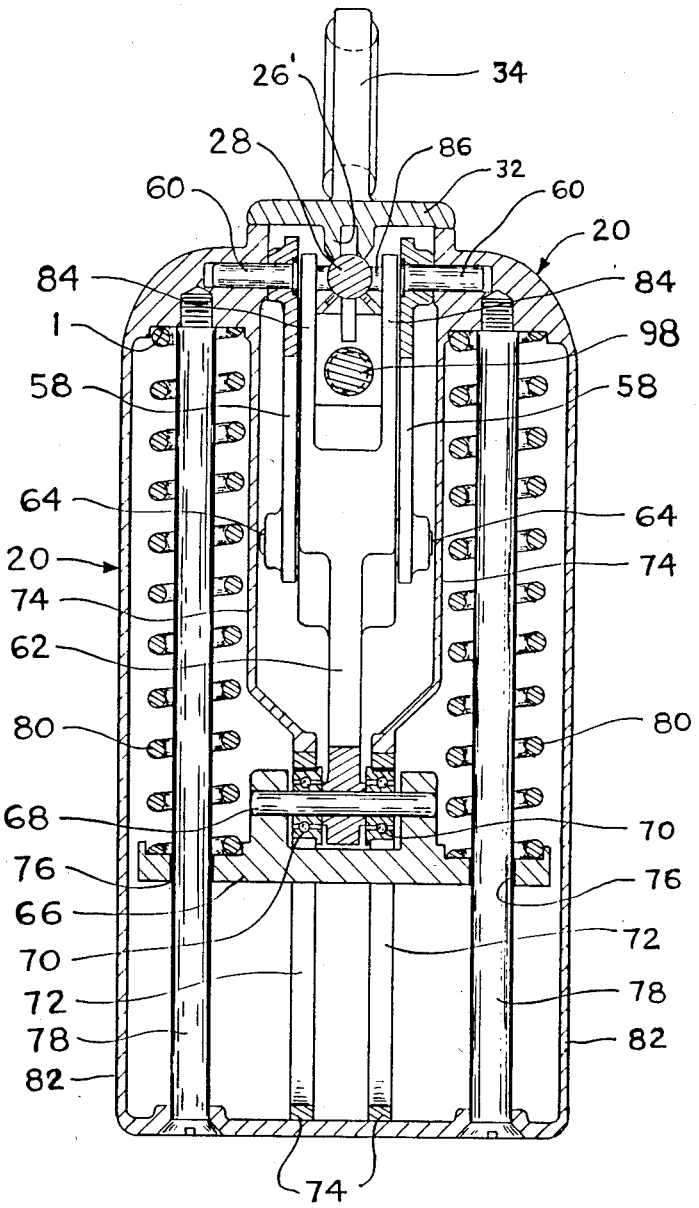
FIG. 5 is a cross-section, on an enlarged scale, taken along line 5—5 of FIG. 1.

The weapon of the invention is of generally elongated shape, having the general appearance of a sub-machine gun and defining a body, generally indicated at 20, forming at the front thereof a barrel 22, and at the back thereof a stock 24. The barrel 22 is of cylindrical shape and interiorly provided with longitudinally-extending ribs 26, as shown in FIG. 3, for guiding along a straight line an elongated missile 28. The rear end portion of the barrel is provided with a top access opening for the insertion of the missile 28 within the front portion of the barrel, said access opening indicated at 30, being closable by a removable cover 32 removably snapped into closed position. Cover 32 preferably carries a handle 34 for carrying the weapon. The stock 24 includes a downwardly-depending hand-grip 36, in front of which is disposed a finger-guard 38 surrounding the trigger lever 40. The rear end portion of the stock 24 forms a butt 42, which is preferably removable from the main portion 44, the stock 24 being removably fixed thereto by a bolt 46, which is accessible through the hollow butt 42, either through a side opening made in butt 42 or by the removal of a shoulder pad 48 removably fixed to the end of the butt 42 by means of bolts 50, and also by the removal of a battery 52, the purpose of which is to be described later on, said battery 52 being supported by the shoulder pad 48 through bracket 54. The weapon has a missile-propelling mechanism, generally shown at 56, and which includes a pair of first levers 58 disposed in side-by-side relationship and of equal size, these levers 58 being pivotally mounted about pivot pins 60 carried by the body 20 forwardly of the trigger lever 40. Pins 60 constitute a pivotal axis which is normal to the longitudinal axis of the barrel 22. A second single lever 62 extends between the levers 58 and is pivoted centrally thereof to the outer end of the levers 58 about a pivot pin 64, which is parallel to the pivotal axis defined by pivot pins 60. One end of the second lever 62 carries a slide block 66 pivoted to the second lever 62 by means of a pivot pin 68, which is parallel to pivot pins 60, 64. The slide block 66 is movable for reciprocating movement, being guided by ball bearings 70 surrounding the pivot pin 68 on each side of the second lever 62 and guided within a slide arrangement consisting of an elongated slot 72 made at the lower end of a wall 74, which is part of the body 20. There is an inner wall 74 with its associated slot 72 on each side of the assembly of the levers 58 and 62, and each slot 72 receives one ball bearing assembly 70.

The slide block 66 has through bores 76 at both ends, each slidably receiving a guide rod 78. Thus, lateral displacement of the slide block is prevented; the guide rods 78 are in the form of long bolts, the inner end being threaded in the body 20. These guide rods also serve to each guide a compression coil spring 80, one end abutting against the body 20 and the other end against the slide block 66. The guide rods 78 and the slots 72 are arranged in a plane which is transverse to the weapon and which is normal to the longitudinal axis of the barrel 22. The inner wall 74 and the outer walls 82 form a casing for the propelling lever mechanism, which is arranged in the plane of hand-grip 36 and which need not be any longer than this hand-grip.

Figure 6:
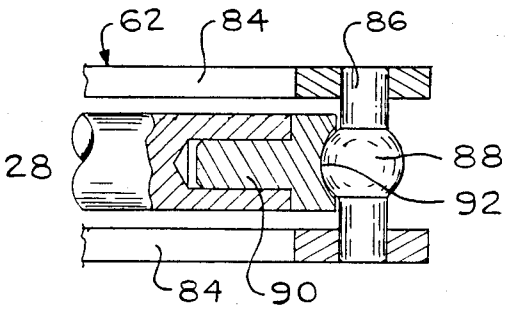
FIG. 6 is a partial plan section showing the rear end of the missile and the missile-propelling member.
Figure 7:
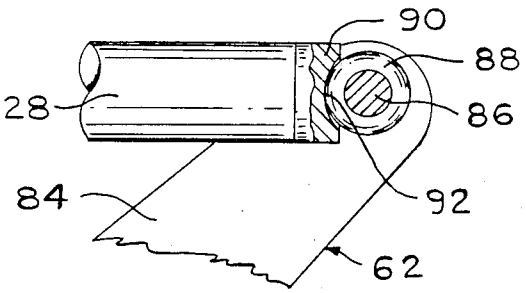
FIG. 7 is a vertical section of the parts shown in FIG. 6.
Figure 8:
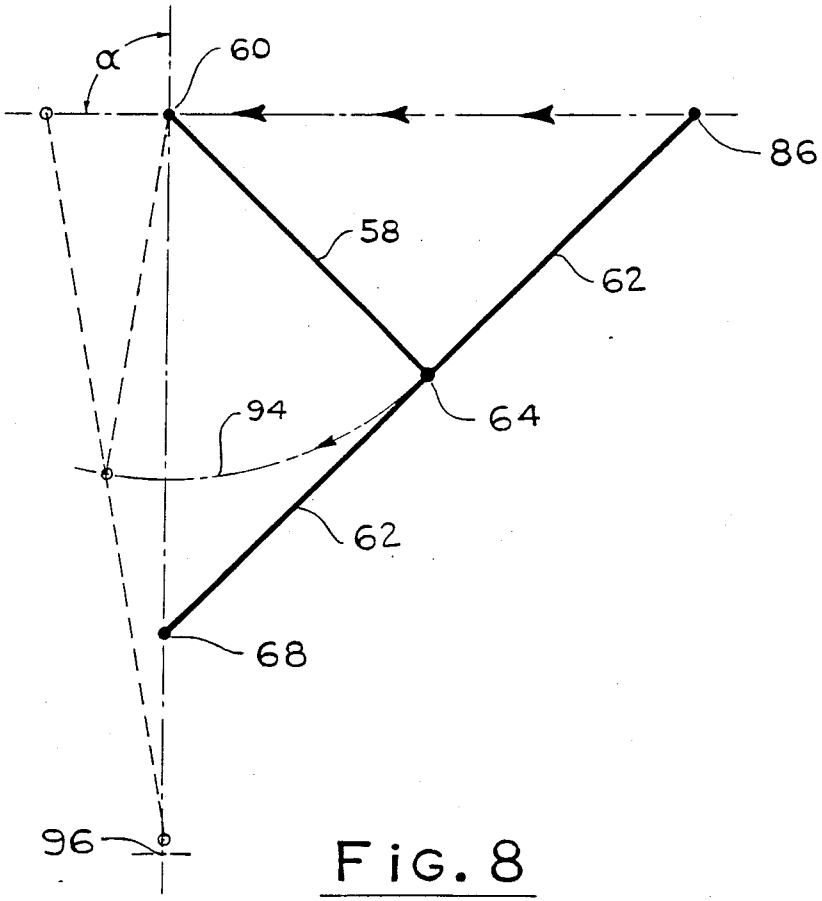
FIG. 8 is a schematic representation of the propelling lever system shown in FIGS. 1 to 7.

The second lever 62 is forked at its upper end portion, defining two laterally-spaced tines 84. Tines 84 carry at their outer end a missle-propelling member 86, in the form of transverse pin interconnecting the two tines 84 with an intermediate partly-spherical bulge 88 (see FIGS. 6 and 7) adapted to contact the rear end of the missile, for instance an arrow 28. Preferably, the rear end of the missile 28 is formed with a bore frictionally receiving a pad 90, made of a permanent magnet material, so as to be magnetically attracted to the bulge 88, the pad 90 being provided with a recess 92 mating with the surface of the bulge 88. The distance between the axis of pivot pins 60 and that of pivot pin 64 is equal to the distance between the axis of pivot pn 64 and of the pivot pin 68 of the slide block 66, and also equal to the distance between pivot pin 64 and the axis of the missile-engaging member 86. The missile-propelling mechanism 56 is shown in cocked position in the drawing. It is clear that the pivot pins 60 of the first levers 58 are well ahead of the missile-engaging member 86 and is in alignment with the slide block 66 along a line normal to the axis of barrel 22. In the cocked position of the mechanism, the first pair of levers 58 extend downwardly and rearwardly from their end pivoted to body 20. In the cocked position, the slide block 66 is in a position at the end of the slide slots 72, which is nearer to the barrel 42 and, therefore, the coiled springs are in their maximum compressed condition. Upon release of the missile-engaging member 86, the compressed coil springs 80 will act on the slide block in the direction away from the barrel 22 and, therefore, the slide block 66 moves away from the barrel in a straight line normal to the barrel axis and intersecting the pivot pins 60. During this movement, the pair of first levers 58 swing forwardly and, therefore, pivot pins 64 move along an arc of a circle, indicated at 94 in FIG. 8, causing compound movement of the second lever 62, such that the missile-engaging member 86 carried thereby will move forwardly in a straight line along the axis of the barrel 22. Furthermore, the missile-engaging member 86 moves with substantially constant aceleration, supposing that slide block 66 moves with a constant speed. Therefore, at the end of the stroke where pivot pins 60, 64, and 68 are in alignment, the acceleration is at a maximum, that is for a given linear displacement of slide block 66 corresponds a maximum increment of linear displacement of the missile-engaging member 86. The two tines 84 are free to move forwardly passed the pivot pins 60 and, therefore, as shown in FIG. 4 and also in FIG. 8, the missile-engaging member 86 can move forwardly beyond pivot pins 60 and also the levers 58 will move beyond the line joining pivot pins 60 and the slide block 66, resulting in reversing movement of the slide block from its lowermost position, shown at 96 in FIG. 8, and therefore resulting in the compression of the coil springs 80, which smoothly decelerate the missile-engaging member 86 and, consequently, the entire missile propelling mechanism. The latter is therefore self-breaking. It ensures that the mechanism is practically noiseless in operation, since no part suddenly strikes a stationary object.

As seen in FIG. 2, the entire propelling mechanism occupies a width transversely of the weapon, which is not greater than the width of the weapon itself, mainly of its body 20, except for the housing for the two coil springs 80, as defined by the transversely-curved outer walls 82. The weapon includes a cocking mechanism which may consist of a threaded rod 98 which is journalled at its end portions 100 and 102 in the body 20. The front end portion 100 has a flange 104 to prevent axial movement of the threaded rod 98. The threaded rod 98 extends below and along an axis parallel to the axis barrel 22. An inwardly-threaded block 106 is threaded on the threaded portion of rod 98, so that rotation of this rod will cause forward or backward movement of block 106.

A catch or hooked lever 108 is pivoted at 110 on the block 106. The catch lever 108 has a front hook portion 112 adapted to engage the cylindrical portion of the missile-engaging member 86, for instance between the same and the two tines 84. There might be provided a forked catch lever 108, with its two tines having a hook 112 engaging in between the missile or arrow 28 and the respective tines 84. Rotation of the rod 98, so as to move the block 106 in a rearward direction with the catch lever 108 engaging the missile-engaging member 86, causes cocking movement of the missile-propelling mechanism and, therefore, compression of coil spring 80. Catch lever 108 has a recess 114 at its rear end, which comes in engagement with the registering leg 116 of a safety catch lever 118 pivoted at 120 to the body 20 and having a finger-engaging tab 122 accessible at the top of the weapon.

The safety catch 118 is resiliently maintained in upright safety position by a leaf spring 124 fixed to the body 20 and engaging one of a pair of notches 126 formed on the edge of the safety catch lever 118. With the catch lever 108 in rearward limit position with the missile-propelling mechanism 56 fully cocked, the safety catch lever 118 maintains the catch lever 108 in hooking engagement with the missile-engaging member 86.

The catch lever 108 is biased to a hooking position under the action of a suitable spring 128 carried by the block 106 and engaging the catch lever 108.

Two alternate means are provided to rotate the threaded rod 98 in either direction of rotation: a manual means and a motorized means. The manual means includes a shaft 130 journalled in the body 20 and coaxial with the threaded rod 98 at the front thereof, being releasably connectable thereto by a clutching collar axially slidably engaging splines 134 at the front end of threaded rod 98 and axially shiftable to establish clutching relationship with the splines 136 at the rear end of the shaft 130. A retaining ring 138, of spring type, is accessible through an opening 140 in the body 20 and the resilient ring 138 is selectively engageable with a notch to retain the clutching collar 132 in clutched or unclutched condition. The shaft 130 is provided with oppositely-inclined spiral grooves 142 engageable by a pawl 144 carried by a pump action type cylindrical handle 146 guided along shaft 130 for reciprocating front and back movement, to thereby rotate the threaded rod 98 continuously in one direction, or continuously in the opposite direction, depending on the position of the pawl 144, this mechanism being similar to a pump action screwdriver.

Threaded rod 98 may be directly driven by an electric motor 148, of reversible type and fed with direct current from battery 52 through a manually-operated switch 150. Motor 148 drives a splined output shaft 152 through a reduction gear box 154. The output 152 can be clutched into driving connection with the threaded rod 98 through a shiftable clutching collar 132. Its retaining ring 138 being accessible to a side opening, not shown, in the weapon body 20. The two driving mechanisms can be mounted on the same weapon, so that in the event the battery 52 becomes discharged, the gun can still be cocked by the pump action handle 146. The threaded rod 98 has been described as being driven in the two directions, namely: in the direction to cock the missile-propelling mechanism 56 and in a return direction to move the block 106 forwardly until the catch lever 108 automatically engages at its hooked end the missile-engaging member 86. However, a mechanism could be provided to release the block 106 in order to quickly slide the same along the threaded rod 98 forwardly to its forward position for engaging the missile-engaging member 86 at its front open position, when the latter has reached its front rest position.

A trigger-and-catch mechanism is provided including the trigger lever 40, the front nose part of which is automatically engageable under the action of a leaf spring 156, with a step 158 of a generally disc-shape cam member 160 pivoted to the body 20 by pivot pin 162, this cam 160 having a second step 164 engaged by a stop pin 166 extending between and carried by the two tines 84 of the second lever 62.

It will be understood that action on the trigger 40 against the bias of leaf spring 156 will release the nose of the trigger 40 from engagement with step 158, allowing anticlockwise rotation of the cam 160 through one-quarter of a circle, whereby step 164 clears the stopper pin 166 which moves along a linear path parallel to the axis of barrel 22.

The cam member 160 is retained in the last-mentioned releasing position by the friction of the nose of the trigger 40 against the curved surface 168 of cam member 160, this friction being achieved by leaf spring 156. Therefore, upon cocking movement of the lever mechanism, the stopper pin 166 will engage the third step 170 of cam member 160, causing clockwise rotation of the cam member 160 through a quarter-turn until the nose of the trigger lever 40 again engages the step 158.

Figure 9:
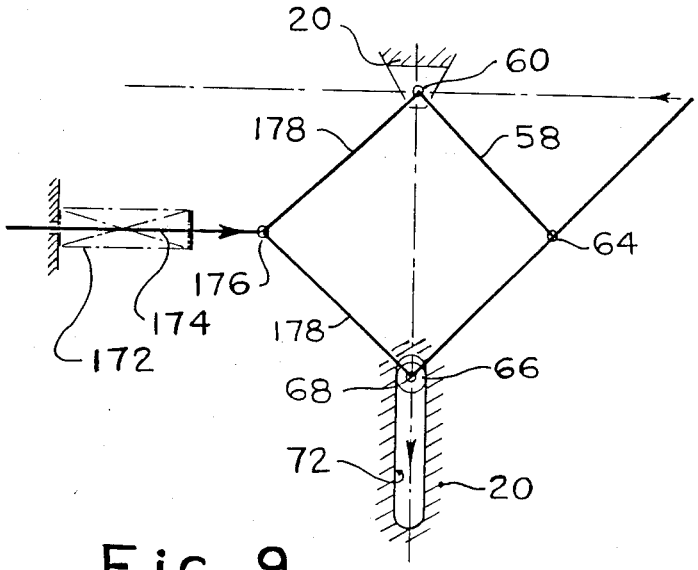
FIGS. 9 and 10 are schematic representations of propelling lever systems in accordance with two other embodiments.
Figure 10:
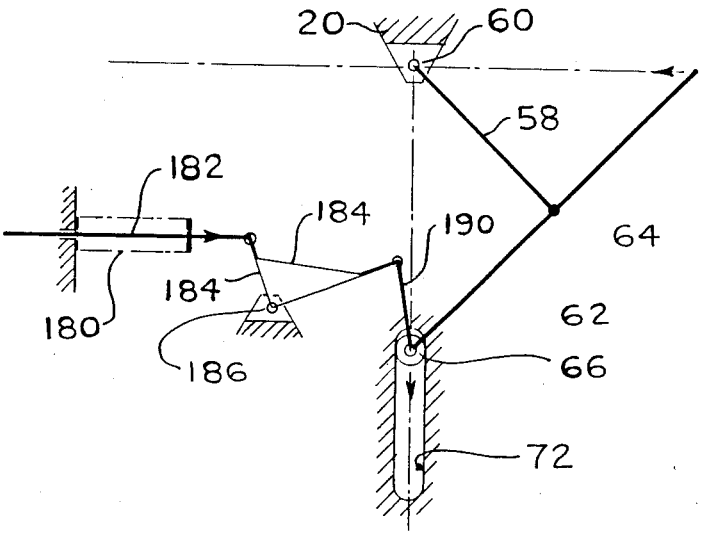

The coil springs 80 could be replaced by any other type of compression springs, with a linear movement, such as Belleville washers. FIG. 9 shows schematically another embodiment of the biasing means to move the missile-propelling mechanism again including the first lever 58 and the second lever 62 pivoted and of the same relative dimensions as in the first embodiment, the slide block arrangement 66 and the slide of slot 72 being similar. The spring arrangement is in the form of a compression coil spring, schematically indicated at 172 and arranged to act in a direction indicated at 174, which is normal to the straight line interconnecting the pivot pins 60 and the pivot pins 68 of the slide block 66. The spring 172 acts on the pivot 176 of a toggle lever arrangement consisting of two lever arms 178 interconnected at 176, of slightly longer length than first lever 58 and half the length of second lever 62. These two levers 178 are pivotally connected at their respective outer ends to the pivot pins 60 and to the slide block 66. This spring arrangement results in a more constant force exerted on the slide block 66 than in the first embodiment. In FIG. 10, there is shown yet another embodiment of the spring arrangement. In this case, a compression coil spring 180 acts again along a line 182 which is normal to the line joining pivot pin 60 to slide block 66. Line 182, which is a push-rod, acts on a crank lever 184 which is pivoted to body 20 at 186, the other longer crank arm 188 of which is pivotally connected by link 190 to the slide block 66. This arrangement permits using a spring 180, having a shorter length and consequently a shorter power stroke than in the other embodiments.

The missiles used with this weapon can be any elongated rod-like missile provided or not with feathers or the like stabilizing means at its rear end. If feathers are used, they should be relatively short, so as to move between the ribs 26 of the barrel 22 and the similar ribs 26' of the access cover 32. Also, the ribs 26, 26' could be spirally arranged so as to cause rotation of the missile in flight for better stabilization.

What we claim is:

1. A weapon for propelling elongated missiles, comprising a rigid, elongated body forming a back stock and a front elongated straight missile-guiding member having a first longitudinal axis, a missile-propelling mechanism carried by said body including a missile-engaging member movable along said first axis between a rearward cocked position and a forward position, a first lever pivoted to said body at one end about a second axis transverse to and intersecting said first axis and forwardly spaced from the cocked position of said missile-engaging member, a second lever centrally pivoted to the free end of said first lever about a third axis parallel to said second axis, a straight slide fixed to said body and normal to said first axis and disposed along an axis line intersecting said second axis, a slide block guided by said slide for reciprocating movement, one end of said second lever pivoted to said slide block about a fourth axis parallel to said second and third axes, and the other end of said second lever carrying said missile-engaging member, the distance between said second and third axis being equal to the distance between said third and fourth axes and equal to the distance between said third axis and said missile-engaging member, biasing means carried by said body and biasing said slide block away from said first axis, catch means carried by said stock for retaining said missile-engaging member in cocked position against the bias of said biasing means and trigger means carried by said stock for releasing said catch means and allowing missile-propelling movement of said mechanism under action of said biasing means, constant speed movement of said block away from said first axis causing forward linear accelerating movement of said missile-engaging member along said first axis, said first lever forwardly pivoting during this movement from a rearwardly-extending position taken when said missile-engaging member is in its cocked position.

2. A weapon as defined in claim 1, wherein said slide block attains a limit position at a maximum distance from said first axis, wherein said third axis is an alignment with said second and fourth axes, whereby defining a straight line, said missile-engaging member and said first lever arranged to respectively move and pivot forwardly of said straight line to thereby move said slide block in a reverse direction towards said first axis, causing said biasing means to store energy, thereby decelerating said missile-engaging member.

3. A weapon as defined in claim 2, wherein said biasing means are compression springs arranged along an axis parallel to said slide.

4. A weapon as defined in claim 2, wherein said biasing means are arranged to act in a direction normal to said slide and further including linkage means located between said biasing means and said slide block.

5. A weapon as defined in claim 4, wherein said linkage means include two lever arms of equal length, the outer ends of said two lever arms pivotally connected to said slide block and to said second axis respectively, and the inner ends of said two lever arms being pivotally interconnected, said biasing means acting on said pivotally interconnected inner ends.

6. A weapon as defined in claim 4, wherein said linkage means includes a crank arm pivoted to said body intermediate its ends and having one arm acted upon by said biasing means and another longer arm pivotally connected to said slide block through a link.

7. A weapon as defined in claim 1, wherein said missile-engaging member includes a partly-spherical metallic member and further including an elongated missile having a tip at its rear end, said tip being a permanent magnet provided with a recess to mate with said partly-spherical member, said magnet being magnetically attracted by the latter.

8. A weapon as defined in claim 1, further including cocking means for said missile-propelling mechanism, said cocking means including a threaded rod rotatably mounted in said body along an axis parallel to said first axis, an inwardly-threaded collar block threadedly retained on said threaded rod, whereby rotation of said rod causes backward movement of said collar, means to rotate said threaded rod and hook means carried by said collar and engageable with said missile-propelling mechanism to cock the same upon rearward movement of said collar.

9. A weapon as defined in claim 8, wherein said hook means is a hooked lever pivotally mounted on said collar and movable between a hooking position hooking said missile-engaging member, and a non-hooking position releasing said missile-engaging member, and a safety catch lever pivotally carried by said body and having a first position engaging said hooked lever in its hooked position and in its rearmost position corresponding to the cocked position of said missile-engaging member to positively retain said hooked lever in said hooked position, pivotal movement of said safety catch lever causing unhooking of said hooked lever.

10. A weapon as defined in claim 8, wherein said means to rotate said threaded rod include a pump action manually-operated mechanism.

11. A weapon as defined in claim 8, wherein said means to rotate said threaded rod include a reversible electric motor carried in said body and having an output shaft coupled to said threaded rod and an electric supply means carried in said body for driving said electric motor.

12. A weapon as defined in claim 8, wherein said means to rotate said threaded rod include a manually-operated pump action means and a clutch member for selectively clutching and unclutching said pump action means to one end of said threaded rod, and an electric motor carried in said body, an electric supply for said motor also carried in said body, said motor having an output shaft and a second clutching means for selectively coupling said output shaft to the opposite end of said threaded rod.

13. A weapon as defined in claim 1, wherein said catch means includes a stop pin carried by said second lever, a cam member pivoted on said body and having two right angular steps in the path of said stopper pin, said cammember having a first position in which a first one of said step engages said stopper pin in the cocked position of said missile-engaging member to retain the latter in said cocked position, said cam-member having a third step, said trigger means including a spring-pressed trigger lever having a nose which, in said first position of said cammember, engages said third step to lock said cam member against rotation in a direction to cause release of said first step from engagement with said stopper pin, release of said cam-member by said trigger lever allowing forward movement of said stopper pin and rotation of said cam-member to a second position in which said second step is in the path of said stopper pin and in which said cam-member is retained in this second position by said nose frictionally engaging a curved portion of said cam-member under the action of the spring of said trigger, cocking movement of said missile-engaging member causing said stopper pin to engage said second step and rotate said cam-member back into its first position and locked by said trigger lever.

* * * * *